United States Patent [19]

Rosen et al.

[11] 3,960,700

[45] June 1, 1976

[54] COAL HYDROGENATION TO PRODUCE LIQUIDS

[75] Inventors: Bernard H. Rosen, Little Silver; Arnold H. Pelofsky, East Brunswick; Marvin Greene, Somerset, all of N.J.

[73] Assignee: Cities Service Company, Tulsa, Okla.

[22] Filed: Jan. 13, 1975

[21] Appl. No.: 540,489

[52] U.S. Cl. ..... 208/8; 208/11 R; 208/142

[51] Int. Cl.[2] ..... C10G 1/06

[58] Field of Search ..... 208/8, 11 R, 107, 142

[56] References Cited

UNITED STATES PATENTS

| | | | |
|---|---|---|---|
| 2,608,526 | 8/1952 | Rex | 208/8 |
| 2,639,982 | 5/1953 | Kalbach | 208/11 R |
| 2,719,112 | 9/1955 | Kearby et al. | 208/11 R |
| 3,030,297 | 4/1962 | Schroeder | 208/8 |
| 3,117,072 | 1/1964 | Eastman et al. | 208/11 R |
| 3,151,054 | 9/1964 | Layng | 208/11 R |
| 3,231,486 | 1/1966 | Perry et al. | 208/8 |
| 3,576,734 | 4/1971 | Bennett | 208/8 |
| 3,617,465 | 11/1971 | Wolk | 208/8 |

FOREIGN PATENTS OR APPLICATIONS

| | | | |
|---|---|---|---|
| 715,167 | 9/1954 | United Kingdom | 208/11 |

*Primary Examiner*—Delbert E. Gantz
*Assistant Examiner*—James W. Hellwege
*Attorney, Agent, or Firm*—George L. Rushton

[57] ABSTRACT

Crushed coal is mixed with hot hydrogen, at 500° to 1,500°C. and 600 to 3,000 psig., in a reactor, and then, after a short reaction time, rapidly quenched. The total heat-up, reaction, and quench time is less than 2 seconds. This short residence time results in less gas production and less polymerization of the liquid components.

7 Claims, 1 Drawing Figure

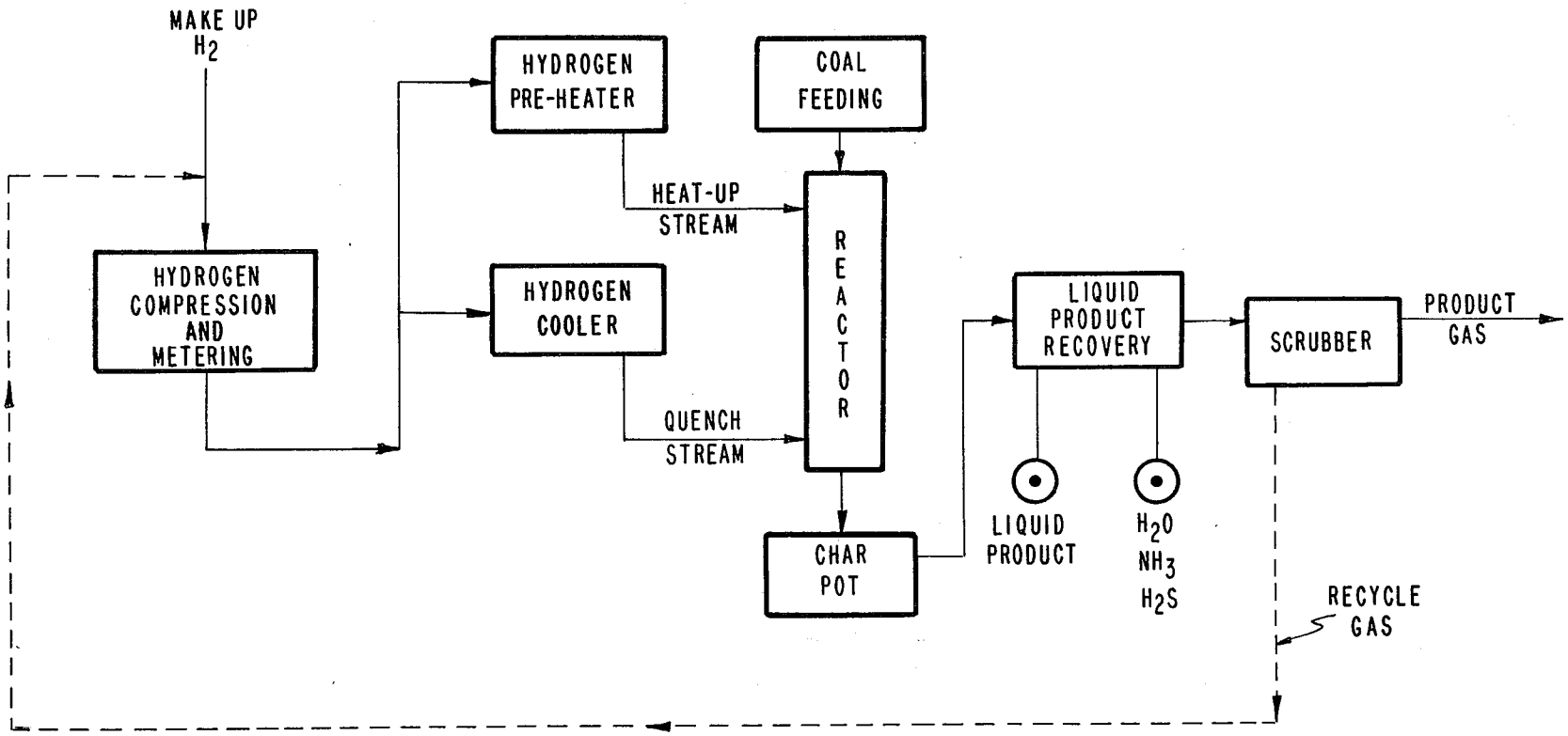
MAKE UP
$H_2$
HYDROGEN
COMPRESSION
AND
METERING
HYDROGEN
PRE-HEATER
HYDROGEN
COOLER
HEAT-UP
STREAM
QUENCH
STREAM
COAL
FEEDING
R
E
A
C
T
O
R
CHAR
POT
LIQUID
PRODUCT
RECOVERY
LIQUID
PRODUCT
$H_2O$
$NH_3$
$H_2S$
SCRUBBER
PRODUCT
GAS
RECYCLE
GAS

COAL HYDROGENATION TO PRODUCE LIQUIDS

BACKGROUND OF THE INVENTION

This invention concerns coal hydrogenation. More particularly, it concerns a process for treating coal with hydrogen, in the absence of any added catalyst and/or solvent, to obtain a maximum of desirable liquid hydrocarbon and a minimum of gaseous and polymerized products. The utility of the invention resides in the production of desirable hydrocarbons from coal.

Processes for treating coal with hydrogen have been known for many years. Prior art references include U.S. Pat. Nos. 2,658,861; 2,832,724; 3,030,297; and 3,152,063. Typically, these processes have mixed crushed coal with various solvents, with or without added catalyst, and have heated the mixture to reaction temperature, for an extended period of time, in the presence or absence of hydrogen. Such processes have generally given a wide range of products, from gases to light hydrocarbons to high-boiling liquids, in addition to the solid residues. For example, U.S. Pat. No. 3,823,084, issued to W. C. Schroeder on July 9, 1974, discloses mixing coal and hydrogen, in the absence of a solvent, passing the mixture through a bed of hydrogenation catalyst, and recovering liquid and gaseous hydrocarbon products from the product stream. The disadvantages of such processes include addition of a catalyst that will survive the severe reaction conditions, removal of the catalyst from the effluent stream, recovery of a broad spectrum of gaseous, low-boiling and high-boiling liquids, the necessity for solvent addition and removal, and additional processing steps to separate, remove and recycle various portions of the reaction stream.

SUMMARY OF THE INVENTION

We believe that we have overcome, or greatly reduced, the disadvantages of prior art processes by our process of treating carbonaceous material with hydrogen, in the absence of added catalyst, with the process comprising the serial steps of (a) adding crushed carbonaceous material to a reactor, (b) adding hot hydrogen to the stream of carbonaceous material, (c) reacting the hydrogen and the carbonaceous material for a period of from about 2 milliseconds to less than 2 seconds, and (d) quenching the mixture within the reactor. In a narrower aspect, the invention concerns a method of converting coal into liquid hydrocarbons, comprising the steps of (a) introducing finely divided coal into a pressure vessel in a continuous stream, (b) continuously adding hot hydrogen to the pressure vessel so as to impinge and heat said coal stream, (c) limiting contact between the hot hydrogen and the coal stream within the vessel to a period of less than 2 seconds, (d) quenching the hot hydrogen-coal stream with cold hydrogen, within the reactor, and (e) separating liquid hydrocarbons from said quenched hydrogen-coal stream. The separated liquid product stream can then be processed further. The heart of the invention resides in the concept of a short total residence time of the carbonaceous material in the reactor, with this residence time including heat-up, reaction, and quench times. This short residence time contrasts sharply with other high pressure hydrogenation processes involving catalysts and solvents, wherein relatively long residence times are involved and the reaction mixture is quenched outside the reactor.

Our process, involving short heat-up and quench times, results in improved yields of desirable products, no problems of catalyst addition or removal, simplified apparatus, and improved process reliability.

The drawing is a block flow diagram of a preferred embodiment of the process. The important portions of the process are found in or near the reactor, involving the addition of carbonaceous material (coal) and hydrogen (both hot and cold), with the other areas of the figure denoting auxiliary and downstream portions involved in the broad process.

DETAILED DESCRIPTION OF THE INVENTION

Feed material for the process broadly includes carbonaceous material, exemplified by coal, lignite, peat, oil shale, tar sands, organic waste, Orinoco tar, gilsonite, and crude oil. A preferred embodiment of the invention uses coal as the solid feed material. It is noted that all of these feed materials, except conventional crude oil, are solids at ambient temperatures.

The solid feed material is crushed to a particle size of less than 1 inch. It is preferred that the particle size be less than about ½ inch, and the most preferred particle size is in the range of 50 to 100 mesh (U.S. Sieve).

The process can utilize almost any hydrogen stream as long as the hydrogen content of the stream is sufficient to react with the carbonaceous material and does not contain deleterious components. Broadly, the incoming hydrogen stream can vary from about 30% hydrogen to about 100% hydrogen, based on the partial pressure of hydrogen. Since recycle of a portion of the effluent gas stream is contemplated in the process, the reactant hydrogen stream can also contain components such as methane, propane, and ethane, with these components typically not condensing as they are cooled to quench temperatures.

Since the process involves the mixing and reaction of carbonaceous material and feed hydrogen, the hydrogen-to-carbonaceous material weight ratio is an important consideration. Broadly, this weight ratio can vary from about 0.05 to about 4, with the higher value showing an excess of hydrogen and the lower value resulting in the formation of more char, with reduced amounts of desirable product. A more desirable hydrogen-to-carbonaceous material weight ratio is in the range of from about 0.12 to about 2, and the most preferred ratio is from about 0.6 to about 1.2.

Since an important aspect of this invention resides in the rapid heating up and cooling down of the reactants and reaction mixture, respectively, the temperature of the incoming reactants is of some importance. Typically, the temperature of the incoming carbonaceous material is desirably ambient. It is recognized that, due to conduction, radiation and convection from the hot reactor, the incoming feed material may be heated somewhat. Any tendency to overheat the material to near-reaction temperatures can be reduced by various designs to cool the feed material or to move it at such a rate that it does not have time to be heated appreciably.

Prior art processes raise the temperature of the reactants comparatively slowly, such as by using preheaters for the reacting mixture or by heating the reactor externally. Our process is based on heating the reactant hydrogen to above the reaction temperature and then rapidly impinging this hot hydrogen onto the incoming carbonaceous feed material, within the reactor.

The temperature of the incoming hot hydrogen will vary somewhat, depending on the desired hydrogen-to-carbonaceous material weight ratio of the reactant mixture and upon the desired reaction temperature in the reactor. Typically the inlet hydrogen temperature should be approximately 50°C. higher than the reaction temperature, when the hydrogen-to-carbonaceous material ratio is around 1, with this temperature difference resulting in a rapid heat-up rate greater than about 500°C. per second.

To overcome the reactor pressure, both the carbonaceous material and the hydrogen must be fed in at a pressure exceeding that of the reactor. Suitable mechanical arrangements, such as a staged pressure or pressurized hopper or star feeder, or pneumatic feeding devices, are available for feedng the carbonaceous material into the pressurized reactor. Cooling coils may be combined with the mechanical arrangements to reduce the tendency to pre-heat the incoming carbonaceous material. Similarly, the pressure of the incoming hydrogen will exceed that of the reactor. The combination of a slight excess of incoming hydrogen pressure and the weight of the incoming carbonaceous material results in a continuous mass flow of reactants through the reactor.

The reaction temperature can vary from about 400° to about 2000°C., with a preferable range being from about 500° to about 1500°C., and a most preferred range of from about 600°C. to about 1000°C. The reactor pressure can vary from about 500 to about 5000 psig, preferably from about 600 to 3000 psig. The total residence time of the reactants in the reactor can vary from about 2 milliseconds to about 2 seconds, preferably from about 5 milliseconds to about 1 second, with a most preferred residence time of from 10 milliseconds to about 900 milliseconds.

This total residence time includes the heat-up, reaction and quench times. Since there is reaction between the carbonaceous material and feed hydrogen as soon as the feed materials enter the reactor and are mixed, and since this reaction continues until the quenched mixture exits the reactor, it is difficult to separate the various phases of the total residence time. It is implicit in the invention that the rates of heat-up and quench be rapid. Direct or indirect quench can be used.

The quench material added directly can be, broadly, any of a wide variety of gases or liquids that can be added quickly to the reactant mixture in order to cool the mixture below the effective reacting temperature, while the mixture is in the reactor. Materials that are non-reactive with the reactant mixture are preferred, but many common materials can be used. These can include a portion of the recycled gas stream from the process (having components such as methane, ethane, propane), a portion of the produced liquid hydrocarbons, inert gases such as helium or argon, and even such materials as water, nitrogen and $CO_2$. Although these latter materials can react at the temperatures found in the reactor, it is understood that these materials can be added to the reactant stream, from the recycle gas stream, at such a temperature and in such volume so that the result is a quenching of the reactant stream, rather than additional reaction between the reactant stream and the quenched material. Hydrogen is thus the preferred quench material, with a process recycle stream rich in hydrogen being a natural extension of the preferred embodiment. Depending upon the reaction temperature and the mass flow through the reactor, a sufficient amount of quenching material, at a suitable temperature, is added to the reactant stream so that the resultant mixture, near the exit of the reactor, has a temperature of about 200°500°C. The temperature and the amount of quench material added are sufficient to quench the reaction mixture rapidly. The pressure of the entering quench material is naturally higher than that of the pressure within the reactor. Desirably, the quench temperature should be below the effective reacting temperature of the components, yet should be high enough to insure that the products of reaction are in the vapor state, to facilitate downstream separation.

The weight ratio of quench material to product stream is dependent upon such factors as the reaction temperature, components of product stream, excess of hydrogen, and other conditions. Quenching is a function of the sensible heat in the reaction mixture and in the quench stream.

After the quenched reaction mixture departs the reactor, any unreacted solid material, such as ash or char, enters the char pot and is recovered therefrom, while the remainder of the effluent stream, typically containing the product vapors, proceeds to downstream processing units, wherein product vapors in the gaseous stream are separated, and various contaminants, such as $NH_3$ and $H_2S$, can be removed from the gaseous stream, by methods familiar to those skilled in the art. A suitable fraction of the gas can be recycled for processing in the units found upstream of the reactor.

Typically, the major products from this process are char, light hydrocarbons, such a methane through $C_5$ hydrocarbons, and aromatics such as benzene, toluene, and xylene.

The hydrogen used in the process can be obtained from any commercial source, such as char gasification, naphtha and/or methane steam reforming, or cracking of ethane to produce ethylene. The steps of producing, storing, heating, cooling and recycling the hydrogen are well known and need not be discussed here. Reactor design, though an important consideration in terms of economics, is not an essential part of this invention. Any reactor design that will allow for the fast heat-up of the feed carbonaceous material, a short reaction time, and a fast quench of the product stream can be used for the invention.

EXAMPLE 1

North Dakota lignite, ground to 100 mesh (U.S.-Sieve), was fed to a hydrogenation reactor. The coal analyzed 10% $H_2O$ and 17% ash, on run-of-mine basis, and assayed 68.2%C, 5.5%H, 22.4% O, 1.5% N, and 2.4% S, on moistureash-free (MAF) basis. Hydrogen, heated to 1335°F. (724°C.), was added concurrently to the reactor at a rate of 3.4 lbs. of hydrogen per lb. of feed coal. The reactor conditions were 1500 psig. and 1300°F. (705°C.). Residence time of the coal in the reactor was approximately 16 seconds. The reaction mixture was quenched by a stream of cold hydrogen (temperature=150°C.), at a rate of 4.5 lbs. cold $H_2$/lb. feed coal. The temperature of the quenched mixture exiting the reactor was below 400°F. (below 204°C.). Processing and analysis of the reactor effluent, neglecting excess $H_2$, gave these results per ton of MAF feed coal;

| | | |
|---|---|---|
| Benzene | 0.75 bbl. | (with minor amounts of toluene and xylene) |
| 200–500°F. fraction | 0.48 bbl. | |
| $CH_4$ | 8180 SCF | |
| $C_2H_6$ | 2580 SCF | |
| char | 545 lbs. | |
| $H_2S$ | 45 lbs. | |
| $NH_3$ | 25 lbs. | |
| $H_2O$ | 350 lbs. | |
| $CO_x$ | 225 lbs. | |

EXAMPLE 2

Using a procedure similar to that of Example 1 and employing the following conditions, the following results can be obtained:

Wyoming Big Horn sub-bituminous coal, at 60 mesh (U.S.Sieve)

4.4% ash and 22.0% $H_2O$, run-of-mine basis assay-MAF basis:

72.6% C
4.8% H
20.8% O
1.3% N
0.5% S

Reactor conditions — 3000 psig and 1450°F. (790°C) $H_2$ preheat temperature — 1550°F (840°C) One lb. $H_2$ added/lb. feed coal Coal residence time — 500 milliseconds Quench stream — 2 lbs. $H_2$ (at-150°C.)/lb. feed coal Temperature of exiting quenched mixture-below 400°F.(below 204°C.)

Products, per ton MAF feed coal:

| | | |
|---|---|---|
| Benzene | 3.0 bbl | (with minor amounts of toluene and xylene) |
| 200°–800°F.fraction | 0.3 bbl | |
| $C_4$ | 5300 SCF | |
| $C_2H_6$ | 1000 SCF | |
| Char | 278 lbs. | |
| $H_2S$ | 10 lbs. | |
| $NH_3$ | 29 lbs. | |
| $H_2O$ | 300 lbs. | |
| $CO_x$ | 220 lbs. | |

EXAMPLE 3

Using the procedure of Example 1 and the following conditions, the following results can be obtained:

Wyoming Glenrock coal, ground to −200 mesh 25% $H_2O$ and 13.5% ash-ROM basis MAF assay -

70.1% C
5.5% H
22.7% O
1.0% N
0.7% S

Reactor conditions — 600 psig and 930°F. (500°C) $H_2$ preheat temperature — 1050°F. (565°C.) 0.5 lb. $H_2$ added/lb. feed coal Coal residence time — 150 milliseconds Quench Stream — 0.5 lb. $H_2$ (−150°C.)/lb. feed coal Quench exit temperature — 450°F. (232°C. Products (per ton of MAF coal) :

| | |
|---|---|
| Benzene (plus toluene and xylene) | 1.1 bbl |
| 200–1000°F. fraction | 0.3 bbl |
| $C_1 - C_2$ fraction | 2900 SCF |
| Char | 1000 lbs. |
| $H_2$, $NH_3$, $H_2O$, $CO_x$ | 560 lbs. |

EXAMPLE 4

Using a procedure similar to that of Example 1 and employing the following conditions, these results can be obtained:

Kentucky No. 11 bituminous coal, ground to −40 mesh 5% $H_2O$ and 6% ash-ROM basis Assay - MAF basis 79.2% C
5.6% H
9.6% O
1.5% N
4.1% S Reactor conditions — 4000 psig and 2730°F. (1500°C) $H_2$ preheat temperature — 2790°F. (1530°C) 7 lbs. $H_2$ added/lb. feed coal Coal residence time — 10 milliseconds Quench Stream — 25 lbs. $H_2$ (−140°C)/lb. feed coal Exit quench temperature — 380°F. (193°C.)

Products, per ton MAF feed coal:

| | |
|---|---|
| BTX mixture | 2.6 bbl. |
| 200°–500°F. fraction | 0.3 bbl. |
| $C_1-C_2$ | 12,000 SCF |
| Char | 180 lbs. |
| $H_2S$, $NH_3$, $H_2O$,$CO_x$ | 500 lbs. |

We claim:

1. A process of treating carbonaceous material with hydrogen, in the absence of added catalyst, comprising in serial combination, a. adding liquid or crushed solid carbonaceous material to a reactor, b. adding hot hydrogen to the stream of carbonaceous material, with the hydrogen/carbonaceous material ratio varying from about 0.05 to about 4, c. reacting the hydrogen and the carbonaceous material at a temperature of from about 400°C. to about 2,000°C., and a pressure of from about 500 to about 5,000 psig., and d. quenching the mixture, with the total residence time varying from about 2 milliseconds to about 2 seconds.

2. The process of claim 1, wherein the crushed solid material has an average particle size smaller than about ½ inch.

3. The process of claim 1, wherein the temperature of the quenched mixture does not exceed about 200°C.

4. The process of claim 1, wherein the quenching material is hydrogen at a temperature below 200°C and the carbonaceous material is coal.

5. A method of converting coal into liquid hydrocarbon comprising the steps of a. introducing finely divided coal into a pressure vessel in a continuous stream, b. continuously adding hot hydrogen to the pressure vessel so as to impinge said coal stream, with the hydrogen/coal weight ratio varying from about 0.05 to about 4, c. reacting coal and hydrogen at a temperature of from about 500° to about 1500°C. and a pressure of from about 600 to about 3,000 psig., and thereafter quenching the reaction mixture with cold hydrogen, thereby limiting contact between the hot hydrogen and the coal stream within the vessel to a period of not more than 2 seconds, said time including heat-up, reaction, and quench times, and d. separating liquid hydrocarbons from coal char and other solid material in the quenched hydrogen/coal stream.

6. The method of claim 5, wherein the separated liquid hydrocarbons are further processed.

7. The method of claim 5, wherein a. the coal has an average particle size of less than about ½ inch, b. the total residence time of hydrogen and coal is not more than about 1 second, c. the cold hydrogen quench stream has a temperature below 200°C., d. the separated liquid hydrocarbon stream is further processed, and e. the char is further processed.

* * * * *